US008978866B2

(12) United States Patent
Kumagai

(10) Patent No.: US 8,978,866 B2
(45) Date of Patent: Mar. 17, 2015

(54) PAPER SHEET HANDLING DEVICE

(75) Inventor: Yusuke Kumagai, Tokyo (JP)

(73) Assignee: Hitachi-Omron Terminal Solutions, Corp., Tokyo (JP)

( * ) Notice: Subject to any disclaimer, the term of this patent is extended or adjusted under 35 U.S.C. 154(b) by 0 days.

(21) Appl. No.: 14/009,764

(22) PCT Filed: Mar. 6, 2012

(86) PCT No.: PCT/JP2012/055704

§ 371 (c)(1),
(2), (4) Date: Oct. 3, 2013

(87) PCT Pub. No.: WO2012/137566

PCT Pub. Date: Oct. 11, 2012

(65) Prior Publication Data

US 2014/0027355 A1 Jan. 30, 2014

(30) Foreign Application Priority Data

Apr. 6, 2011 (JP) ..... 2011-084855

(51) Int. Cl.
*G07F 7/04* (2006.01)
*G07D 11/00* (2006.01)

(52) U.S. Cl.
CPC ..... *G07D 11/0084* (2013.01); *G07F 7/04* (2013.01)
USPC ..... 194/206; 209/534

(58) Field of Classification Search
CPC ..... G07D 7/00; G07D 11/0084; G07F 7/00; G07F 7/04
USPC ..... 194/206, 207; 209/534; 235/379; 902/8, 902/9, 11, 12, 13; 700/215, 219, 223, 224, 700/225
See application file for complete search history.

(56) References Cited

U.S. PATENT DOCUMENTS

| | | | | |
|---|---|---|---|---|
| 6,043,456 | A | 3/2000 | Meyer et al. | |
| 8,074,806 | B2 * | 12/2011 | Ozaki et al. | 209/534 |
| 8,371,429 | B2 * | 2/2013 | Hamasaki | 194/207 |
| 2001/0015309 | A1 * | 8/2001 | Ikuta | 194/206 |
| 2008/0150216 | A1 | 6/2008 | Ichikawa et al. | |

FOREIGN PATENT DOCUMENTS

| | | | |
|---|---|---|---|
| JP | 06-044442 | A | 2/1994 |
| JP | 08-245040 | A | 9/1996 |
| JP | 09-153169 | A | 6/1997 |
| JP | 10-071690 | A | 3/1998 |
| JP | 11-272922 | A | 10/1999 |
| JP | 2002-008098 | A | 1/2002 |
| JP | 2008-152430 | A | 7/2008 |

* cited by examiner

*Primary Examiner* — Mark Beauchaine
(74) *Attorney, Agent, or Firm* — Volpe and Koenig, P.C.

(57) ABSTRACT

Provided is a paper sheet handling device with which paper currency having an optimal property can be deposited and disbursed without reducing the number of denominations than can be handled, and without changing the higher-level system. This paper sheet handling device is equipped with: multiple cassettes provide respectively for each classification based on the value of a paper sheet, with each of the multiple cassettes having multiple housing units a storage unit that associates and stores a housing unit housing status, and a main control unit, which executes paper sheet deposit/disbursement processes on the basis of the housing unit housing status and the cassette housing status stored by the storage unit.

9 Claims, 8 Drawing Sheets

FIG. 3

| STATUS NUMBER | AMOUNT OF PAPER CURRENCY IN DEDICATED WITHDRAWAL ONLY HOUSING UNIT (UPPER-LEVEL) | AMOUNT OF PAPER CURRENCY IN DEDICATED WITHDRAWAL ONLY HOUSING UNIT (LOWER-LEVEL) | AMOUNT OF PAPER CURRENCY IN CASSETE AS A WHOLE |
|---|---|---|---|
| 1 | EMPTY | EMPTY | EMPTY |
| 2 | EMPTY | PAPER CURRENCY PRESENT | PAPER CURRENCY PRESENT |
| 3 | EMPTY | FULL | FULL |
| 4 | PAPER CURRENCY PRESENT | EMPTY | PAPER CURRENCY PRESENT |
| 5 | PAPER CURRENCY PRESENT | PAPER CURRENCY PRESENT | PAPER CURRENCY PRESENT |
| 6 | PAPER CURRENCY PRESENT | FULL | FULL |
| 7 | FULL | EMPTY | PAPER CURRENCY PRESENT |
| 8 | FULL | PAPER CURRENCY PRESENT | PAPER CURRENCY PRESENT |
| 9 | FULL | FULL | FULL |

FIG. 6

| STATUS NUMBER | AMOUNT OF PAPER CURRENCY IN HOUSING UNIT CAPABLE OF DEPOSIT AND WITHDRAWAL (UPPER-LEVEL) | AMOUNT OF PAPER CURRENCY IN HOUSING UNIT CAPABLE OF DEPOSIT AND WITHDRAWAL (LOWER-LEVEL) | AMOUNT OF PAPER CURRENCY IN CASSETTE AS A WHOLE |
|---|---|---|---|
| 1 | EMPTY | EMPTY | EMPTY |
| 2 | EMPTY | PAPER CURRENCY PRESENT | PAPER CURRENCY PRESENT |
| 3 | EMPTY | FULL | PAPER CURRENCY PRESENT |
| 4 | PAPER CURRENCY PRESENT | EMPTY | PAPER CURRENCY PRESENT |
| 5 | PAPER CURRENCY PRESENT | PAPER CURRENCY PRESENT | PAPER CURRENCY PRESENT |
| 6 | PAPER CURRENCY PRESENT | FULL | PAPER CURRENCY PRESENT |
| 7 | FULL | EMPTY | PAPER CURRENCY PRESENT |
| 8 | FULL | PAPER CURRENCY PRESENT | PAPER CURRENCY PRESENT |
| 9 | FULL | FULL | FULL |

FIG. 8

| STATUS NUMBER | AMOUNT OF PAPER CURRENCY AT HOUSING UNIT CAPABLE OF DEPOSIT AND WITHDRAWAL (UPPER-LEVEL) | AMOUNT OF PAPER CURRENCY AT HOUSING UNIT CAPABLE OF DEPOSIT AND WITHDRAWAL (LOWER-LEVEL) | AMOUNT OF PAPER CURRENCY IN CASSETTE AS A WHOLE |
|---|---|---|---|
| 1 | EMPTY | EMPTY | EMPTY |
| 2 | EMPTY | PAPER CURRENCY PRESENT | EMPTY |
| 3 | EMPTY | FULL | EMPTY |
| 4 | PAPER CURRENCY PRESENT | EMPTY | PAPER CURRENCY PRESENT |
| 5 | PAPER CURRENCY PRESENT | PAPER CURRENCY PRESENT | PAPER CURRENCY PRESENT |
| 6 | PAPER CURRENCY PRESENT | FULL | PAPER CURRENCY PRESENT |
| 7 | FULL | EMPTY | PAPER CURRENCY PRESENT |
| 8 | FULL | PAPER CURRENCY PRESENT | PAPER CURRENCY PRESENT |
| 9 | FULL | FULL | FULL |

PAPER SHEET HANDLING DEVICE

BACKGROUND OF THE INVENTION

1. Technical Field of the Invention

The present invention relates to a paper sheet handling device such as the one mounted in a cash automatic transaction device used in, for example, a banking institution.

2. Description of Related Arts

Conventionally, in a cash automatic transaction device used in a banking institution or the like, for paper sheet of a specific denomination (kind of paper currency when classification is made based on a value written on the paper currency), for example, to withdraw only the paper currency with a specific property (kind of the paper currency when the paper currency is classified based on an element other than the denomination), as many paper currency housing units capable of withdrawal as the number of combinations of a denomination to be withdrawn in the paper sheet handling device and its property are prepared. Then the denomination to be handled in each paper currency housing unit and its property are determined and the paper currency housing unit from which withdrawal is performed by the cash automatic transaction device is specified to thereby withdraw the paper currency of the specific kind with the specific property (for example, Japanese Patent Application No. H10-71690 and Japanese Patent Application No. 2000-189241).

In the conventional art, to withdraw paper currency with a specific property in addition to withdrawing a specific denomination, in order to keep the number of denominations that can be handled, the same number of housing units as that of combinations of a denomination to be withdrawn and its property are required, which leads to an increase in the number of housing units. As a result, a larger space is required for the paper sheet handling device or the automatic transaction device, raising a problem that the device itself is upsized. Such a situation is not limited to a case where the paper currency is to be withdrawn and similarly becomes a problem upon paper currency deposit. Moreover, even if it is possible to ensure such a space, to achieve synchronization between the paper sheet handling device and a high-level system (for example, cash automatic transaction device), in response to an increase in the number of housing units, a change in housing unit operations such as settings made on each housing unit from the high-level system or information acquisition therefrom is required.

On the other hand, to keep the number of housing units, the same number of housing units as that of properties handled are is required for each denomination, thus resulting in a decrease in the number of denominations that can be handled. As described above, the conventional technology has faced a problem that paper currency with an optical property cannot be deposited and withdrawn without reducing the number of denominations that can be handled and without changing the high-level system.

SUMMARY OF THE INVENTION

In view of the above, the present invention has been made, and it is an object of the invention to provide a paper sheet handling device capable of depositing and withdrawing paper currency with an optical property without reducing the number of denominations that can be handled and also without changing a high-order system.

To address the problem described above, a paper sheet handling device according to the invention performs paper-sheet-related transaction with a customer. The paper sheet handling device includes: a deposit and withdrawal port for depositing and withdrawing the paper sheet; a plurality of cassettes being provided for each kind indicating a kind of the paper sheet when classification is made based on a value of the paper sheet, the cassettes each having a plurality of housing units capable of housing paper sheets with mutually different properties indicating the kinds of the paper sheet when the paper sheet is classified based on an element other than the kind; an identification unit being provided between the deposit and withdrawal port and the plurality of cassettes, the identification unit identifying the kind and the property of the paper sheet deposited through the deposit and withdrawal port; a conveyance path linking together the deposit and withdrawal port, the identification unit, and each of the housing units; a storage unit storing in association: a housing unit housing status as a housing status of the paper sheet for each of the plurality of housing units; and a cassette housing status as a housing status of the paper sheet in the cassette as a whole having the plurality of housing units; and a main control unit executing deposit and withdrawal processing of the paper sheet based on the housing unit housing status and the cassette housing status stored in the storage unit, storing in the storage unit the housing unit housing status and the cassette housing status after the execution, and reporting the stored housing unit housing status and cassette housing status to a high-level device managing the paper sheet handling device.

The present invention provides effect that a paper sheet handling device capable of depositing and withdrawing paper currency with an optimal property without reducing the number of denominations that can be handled and without changing a high-level system.

BRIEF DESCRIPTION OF THE DRAWINGS

FIG. 3 is a diagram showing an example of a status table stored by a storage unit according to the first embodiment;

FIG. 6 is a diagram showing an example of a status table stored by a storage unit according to the second embodiment;

FIG. 8 is a diagram showing an example of a status table stored by a storage unit according to the third embodiment.

DETAILED DESCRIPTION OF PREFERRED EMBODIMENTS

Hereinafter, embodiments of a paper sheet handling device according to a present invention will be described in detail with reference to the accompanying drawings. Hereinafter, the paper sheet handling device according to the invention will be described referring to a case where it is applied to an ATM (Automated teller machine) adopted by a banking institution, but it is not limited thereto as long as it has a function of discharging a paper sheet, such as paper currency or a certificate, with identification information and performing transaction with a customer.

First Embodiment

In this embodiment, a case is described where a paper currency housing unit in a cassette included in the paper sheet handling device has two levels (upper and lower levels), the upper level handles authorized bills and the lower level handles circulated bills, the authorized bills are specified as paper currency to be withdrawn, and the specified authorized bills are withdrawn. Hereinafter, a kind of paper currency for classification based on a money amount (value) written on the paper currency is called a denomination of the paper currency, and a kind of paper currency for classification based on an element other than the denomination is called a property of the paper currency. Moreover, the "authorized bill" indicates paper currency never used after its issue, and the "circulated bill" indicates paper currency used at least once after its issue.

Figure 1:
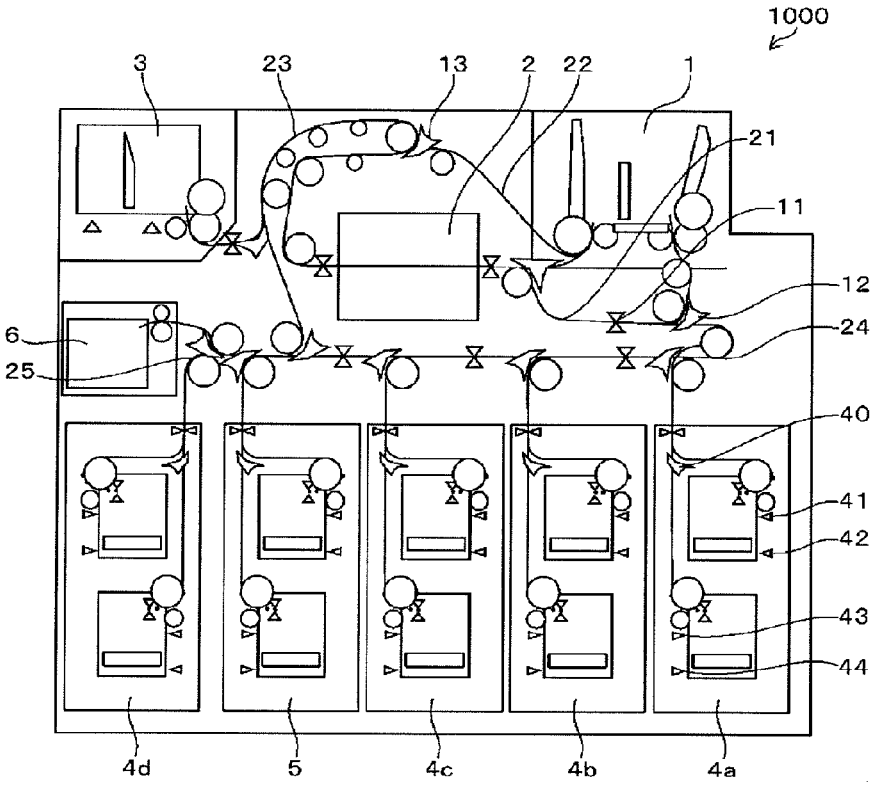
FIG. 1 is a schematic diagram showing configuration of a paper sheet handling device according to a first embodiment of the present invention.

FIG. 1 is a schematic diagram showing configuration of a paper sheet handling device 1000 according to this embodiment. As shown in FIG. 1, the paper sheet handling device 1000 has: a deposit and withdrawal port 1 through which a user deposits and withdraw paper currency; an identification unit 2 identifying a denomination, property, etc. of the paper currency; a temporary hold unit 3 temporarily accumulating counted paper currency; cassettes 4*a* to 4*d* accumulating the paper currency on an individual denomination basis; a reject cassette 5 accumulating paper currency rejected by the identification unit 2; a forgotten paper currency collection box 6 accumulating the paper currency that the user forgot to take out; a passage sensor 11 detecting passage of paper currency; gates 12 and 13 switching a conveyance route of paper currency; and conveyance paths 21 to 25 conveying paper currency to the various units described above.

The cassettes 4*a* to 4*d* have two paper currency housing units divided into an upper level and a lower level. Moreover, the cassettes 4*a* to 4*d* include: a cassette internal gate 40 switching a conveyance destination of paper currency in the cassette; an upper level housing unit empty detecting sensor 41 detecting that the upper level paper currency housing unit has become empty; an upper housing unit full detecting sensor 42 detecting that the upper level paper currency housing unit has become full; a lower level housing unit empty detecting sensor 43 detecting that the lower level paper currency housing unit has become empty; and a lower level housing unit full detecting sensor 44 detecting that the lower level paper currency housing unit has become full. Each of the cassettes is attachable and detachable to and from the paper sheet handling device 1000, and is provided in accordance with a dimension of paper currency divided according to the kind (paper currency size such as ten thousands yen bill or five thousand yen bill).

Figure 2:
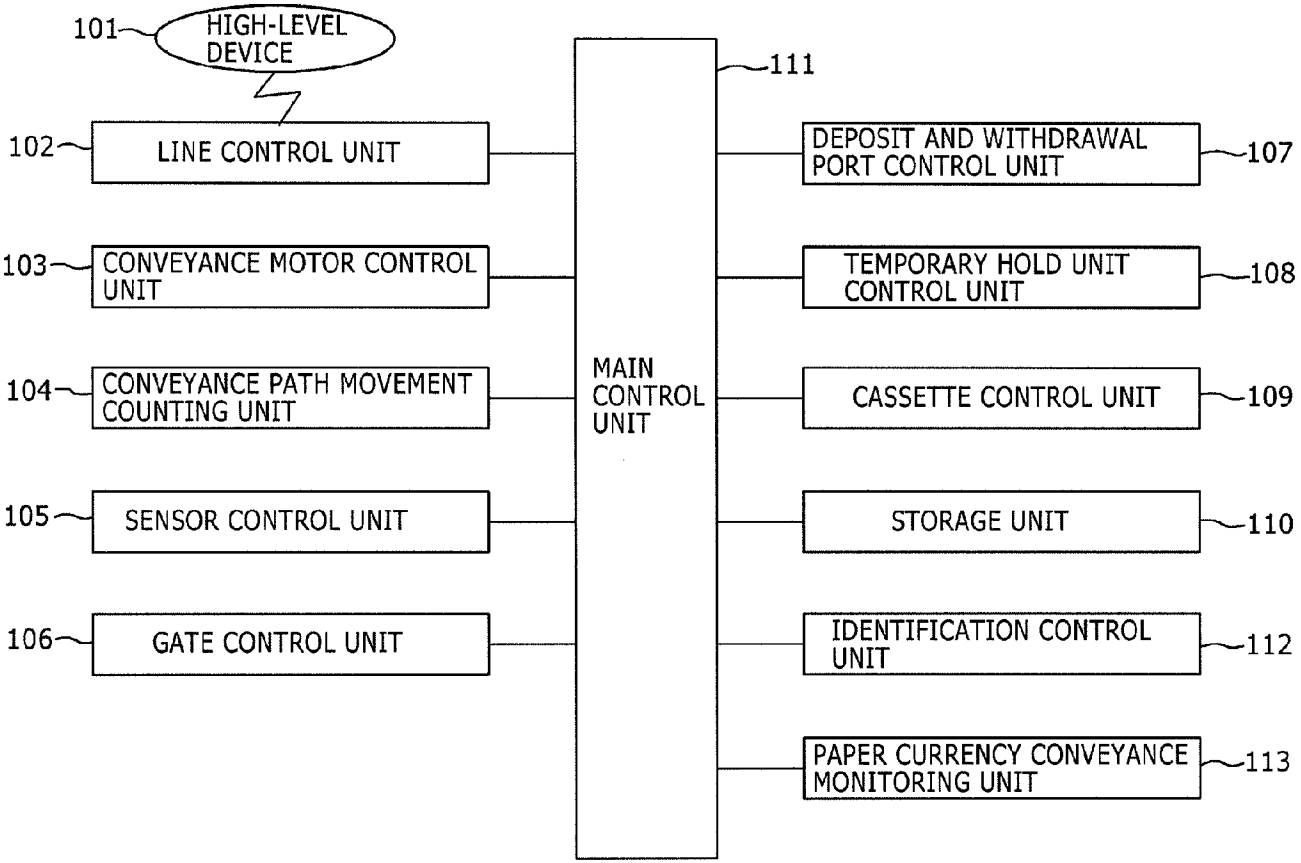
FIG. 2 is a block diagram showing functional configuration of the paper sheet handling device shown in FIG. 1.

FIG. 2 is a block diagram showing functional configuration of the paper sheet handling device 1000 shown in FIG. 1. As shown in FIG. 2, the paper sheet handling device 1000 has: a line control unit 102 which is a different unit from the paper sheet handling device 1000 and which makes communication with a high level device 101 located at a higher level than the paper sheet handling device 1000 as a main body control unit of an automatic teller machine (ATM) installed in, for example, a banking institution; a conveyance motor control unit 103 controlling a conveyance path driving motor; a conveyance path movement counting unit 104 counting movement through the conveyance path; a sensor control unit 105 controlling a sensor such as a passage sensor that detects passage of paper currency; a gate control unit 106 switching the gate in order that paper currency is conveyed to a predetermined accumulation destination; a deposit and withdrawal port control unit 107 controlling, for example, separation of paper currency from the deposit and withdrawal port and accumulation of paper currency at the deposit and withdrawal port; a temporary hold unit control unit 108 controlling, for example, separation of paper currency from the temporary hold unit and accumulation of paper currency onto the temporary hold unit; a cassette control unit 109 controlling, for example, separation of paper currency from each cassette and accumulation of paper currency onto each storage; a storage unit 110 storing various pieces of information (for example, a status table indicating a status of paper currency accumulated on the cassette) for performing each process to be described below; a main control unit 111 controlling each portion forming the paper sheet handling device 1000; an identification control unit 112 reporting identification results of paper currency to the main control unit 111; and a paper currency conveyance monitoring unit 113 monitoring, based on accumulation destination information determined by the main control unit 111 and sensor information from the sensor control unit 105, that paper currency on the conveyance path is properly conveyed from feeding to accumulation, and reporting to the main control unit 111 in a case where conveyance abnormality has been detected.

FIG. 3 is a diagram showing an example of the status table stored by the storage unit 110. As shown in FIG. 3, the status table stores in association: status numbers for identifying a status of paper currency in the paper currency housing unit; amounts of paper currency in the upper-level paper currency housing unit; amounts of paper currency in the lower-level paper currency housing unit; and a total amount of paper currency in the cassette concerned. In an example below, the upper-level paper currency housing unit is desiccated for withdrawal processing, and the lower-level paper currency housing unit is used for both deposit processing and withdrawal processing.

In the example shown in FIG. 3, if both the amount of paper currency in the upper-level paper currency housing unit and the amount of paper currency in the lower-level paper currency housing unit are "Empty" (status number 1), the main control unit 111 determines that the amount of paper currency in this cassette as a whole is in an "Empty" status. Similarly, if the amount of paper currency in the upper-level paper currency housing unit is "empty" and the amount of paper currency in the lower-level paper currency housing unit is "Paper currency Present" (status number 2), the main control unit 111 determines that the amount of paper currency in this cassette as a whole is in a "Paper currency Present" status. The reason why it is determined that the cassette as a whole is in the "Paper currency Present" status even when the upper-level paper currency housing unit is in the "Empty" status is that withdrawal can be performed with "circulated bills" housed in the lower-level paper currency housing unit. Note that, however, at this point, if an operation display unit (not shown) formed of, for example, a touch panel receiving deposit and withdrawal operation from an user of an ATM in withdrawal processing has received an instruction for not withdrawing the "circulated bill" (that is, for withdrawing the "authorized bill"), or if the storage unit 110 previously stores that only the "authorized bill" is withdrawn as withdrawn paper currency, the main control unit 111 determines that the amount of paper currency in the cassette as a whole is in an "empty" status even when the lower-level paper currency housing unit is in the "Paper currency Present" status.

Moreover, if the amount of paper currency in the upper-level paper currency housing unit is "Empty" and the amount of paper currency in the lower-level paper currency housing unit is "Full" (status 3), the main control unit 111 determines that the amount of paper currency in this cassette as a whole is in a "Full" status. The reason why the cassette as a whole is in the "Full" status even when the upper-level paper currency housing unit is in the "Empty" status is that paper currency cannot be housed in the lower-level paper currency housing unit in the deposit processing. Note that, however, at this point, if the operation display unit (not shown) described above has received an instruction for not withdrawing the "circulated bill" (that is, for withdrawing the "authorized bill") in the withdrawal processing at this point, or if the storage unit 110 previously stores that only the "authorized bill" is withdrawn as withdrawn paper currency, the main control unit 111, as is the case with the aforementioned case, determines that the amount of paper currency in the cassette as a whole is in an "Empty" status even when the lower-level paper currency housing unit is in the "Paper currency Present" status.

Further, if the amount of paper currency in the upper-level paper currency housing unit is "Paper currency Present" and the amount of paper currency in the lower-level paper currency housing unit is "Empty" (status number 4), the main control unit 111 determines that the amount of paper currency in this cassette as a whole is in a "Paper currency Present" status. The reason why it is determined that the cassette as a whole is in the "Paper currency Present" status even when the lower-level paper currency housing unit is in "Empty" status is that withdrawal can be performed by the "authorized bill" housed in the upper-level paper currency housing unit. Note that, however, at this point, withdrawal can be performed only from the upper-level paper currency housing unit in the withdrawal processing.

Moreover, if both the upper-level paper currency housing unit and the lower-level paper currency housing unit are in a "Paper currency Present" status (status number 5), the main control unit 111 determines that the cassette as a whole is in a "Paper currency Present" status, and if the upper-level paper currency housing unit is in a "Full" status and the lower-level paper currency housing unit is in a "Paper currency Present" status (status number 8), the main control unit 111 determines that the cassette as a whole is in a "Paper currency Present" status. This is because both the deposit processing and the withdrawal processing can be performed in these statuses.

Moreover, if the upper-level paper currency housing unit is in a "Paper currency Present" status and the lower-level paper currency housing unit is in a "Full" status (status number 6), the main control unit 111 determines that the cassette as a whole is in a "Full" status. The reason why it is determined that the cassette as a whole is in the "Full" status even when the upper-level paper currency housing unit is in the "Paper currency Present" status is the same as the reason for the case of the status number 3 described above.

Further, if the amount of paper currency in the upper-level paper currency housing unit is "Full" and the amount of paper currency in the lower-level paper currency housing unit is "Empty" (status number 7), the main control unit 111 determines that the amount of paper currency in this cassette as a whole is in a "Paper currency Present" status. The reason why the cassette as a whole is in the "Paper currency Present" status even when the lower-level paper currency housing unit is in the "Empty" status is the same as the reason for the case of the status number 4 described above. Note that if both the amounts of paper currency in the upper-level paper currency housing unit and the lower-level paper currency housing unit are "Full" (status 9), it is determined that the amount of paper currency in this cassette as a whole is in a "Full" status.

As described above, the main control unit 111, upon every performance of deposit processing or withdrawal processing, updates the status table stored in the storage unit 110 and stores this status. Then the main control unit 111, after the update of the status table, transmits the updated status table to the high level device 101 and thereby reports its contents.

This embodiment is described based on the assumption that the storage unit 110 is a recording medium such as a memory that is provided outside of the main control unit 111, but may be an internal memory that is provided inside of the main control unit 111. Moreover, the main control unit 111 (simply referred to as a control unit) is formed of an arithmetic unit such as a CPU (Central Processing Unit), and loads into a RAM (Random Access Memory), not shown, a program recorded on a ROM (Read Only Memory), not shown, to thereby execute various processing to be described below and execute transaction with the user. Subsequently, the withdrawal processing performed in the paper sheet handling device 1000 will be described.

Figure 4:
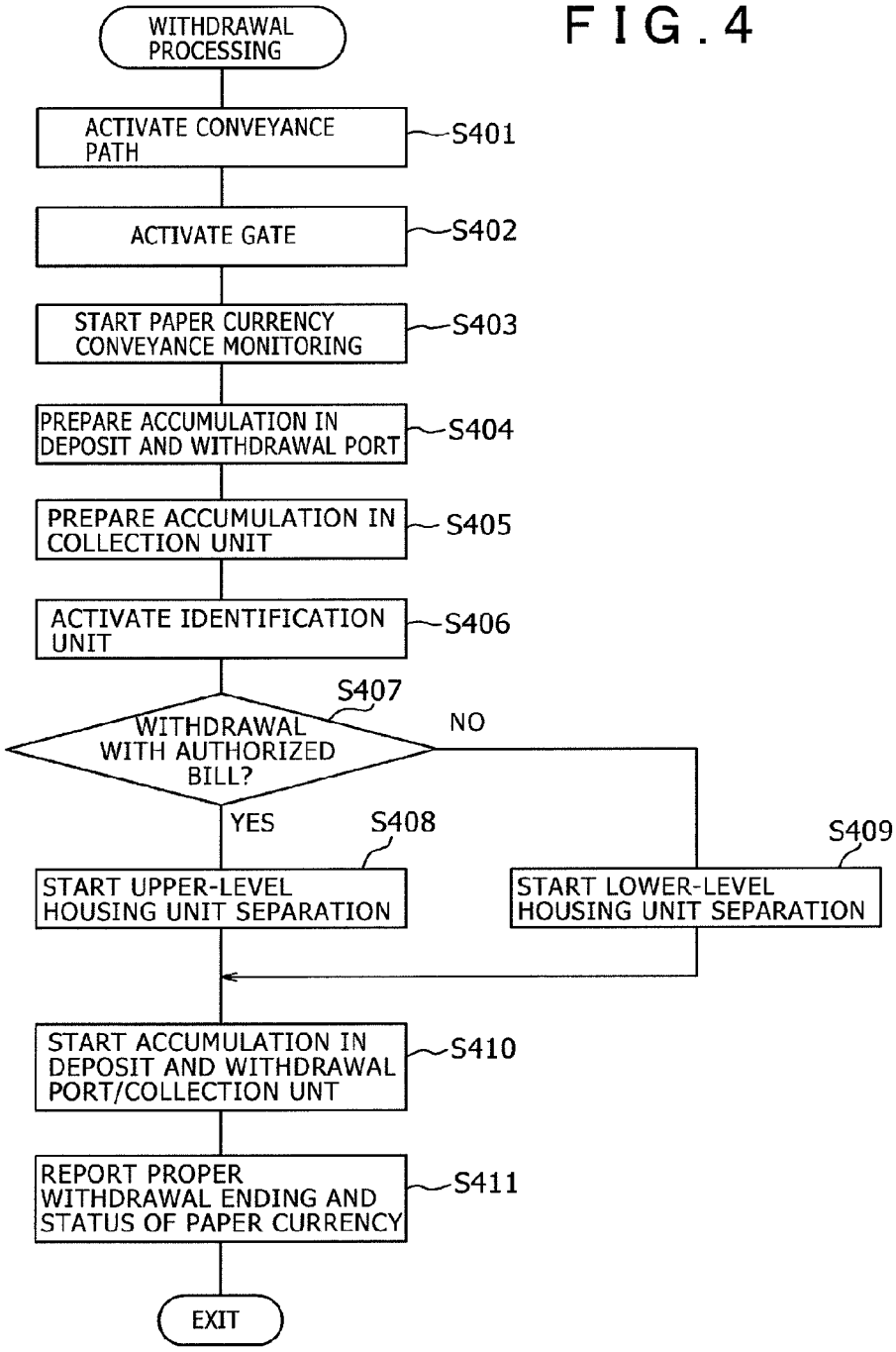
FIG. 4 is a flow chart showing process procedures of withdrawal processing performed in the paper sheet handling device according to the first embodiment.

FIG. 4 is a flow chart showing process procedures of the withdrawal processing performed in the paper sheet handling device 1000. In the processing below, the upper-level paper currency housing unit is a housing unit desiccated for withdrawal for the purpose of handling authorized bills, and the lower-level paper currency housing unit is a housing unit capable of deposit and withdrawal for the purpose of handling circulated bills. The main control unit 111 refers to the status table shown in FIG. 3 and, based on the amount of paper currency in the withdrawal only housing unit and the amount of paper currency in the deposit only housing unit, determines the amount of paper currency in the cassette as a whole as a whole, and reports to the high level device 101 the amount of paper currency in the cassette as a whole determined as the amount of paper currency for each cassette. By performing processing described below, the high level device 101 can recognize that if the amount of paper currency for each cassette reported from the main control unit 111 is empty, this cassette is capable of depositing but not capable of withdrawing, that if it is "Paper currency Present", the cassette is capable of depositing and withdrawing, and that if it is "Full", this cassette is not capable of depositing but capable of withdrawing.

As shown in FIG. 4, upon reception of a withdrawal instruction from the high level device 101 via the high-level line control unit 102, the main control unit 111 activates the conveyance paths 21 to 25 to cause rotation from the cassettes 4*a* to 4*d* towards the deposit and withdrawal port 1 (step 401), switches a gate 12 in a conveyance direction from the cassettes 4*a* to 4*d* towards the identification unit 2 (step 402), and provides a paper currency monitoring instruction to the paper conveyance monitoring unit 113 (step 403).

Then the main control unit 111 instructs the deposit and withdrawal port control unit 107 for accumulation preparation of the deposit and withdrawal port 1 (step 404), instructs the cassette control unit 109 for accumulation preparation of the reject cassette 5 (step 405), and instructs the identification control unit 112 for activation of the identification unit 2 (step 406).

Then by determining, for example, whether or not currency exchange is to be performed and whether or not an instruction for withdrawing an authorized bill has been received from the operation display unit (not shown) the main control unit 111 determines whether or not the withdrawal instruction from the high level device 101 corresponds to withdrawal, for example, currency exchange withdrawal, for which the authorized bill is preferable (step 407), and upon determination that the authorized bill is preferable for withdrawal (Yes in step 407), further refers to the status table shown in FIG. 3, gives instructions for withdrawal from the upper-level paper currency housing unit capable of withdrawal, and individually separates a specified number of paper currency (bills) from the cassette housing the specified denomination (step 408).

Upon determination that the authorized bill is not preferable for withdrawal (No in step 407), the main control unit 111 give instructions for withdrawal from the lower-level paper currency housing unit capable of withdrawal and individually separates the specified number of paper currency (bills) from the cassette housing the specified denomination (step 409).

Then the paper currency fed from the paper currency cassette passes through the conveyance paths 24 and 21, authenticity, a denomination, and a conveyance status of the paper currency and whether it is proper or loss are judged at the identification unit 2, identification results are reported from the identification control unit 112 to the main control unit 111 and the main control unit 111 determines a proper bill or a rejected bill based on the identification results, and accumulates the proper bill at the deposit and withdrawal port 1 or the reject cassette 5 (step 410). Note that the proper bill is paper currency with little defacement suitable for circulated, as described below in a third embodiment.

After the specified amount of paper currency is accumulated at the deposit and withdrawal port 1, the main control unit 111 instructs the conveyance motor control unit 103 for stopping the conveyance paths 21 to 25, and reports proper withdrawal ending and a cassette status after the withdrawal to the high level device 101 via the high-level line control unit 102 (step 411). Upon end of this processing in step 412, all the processes of the withdrawal processing shown in FIG. 4 end.

As described above, the main control unit 111 determines the amount of paper currency in the cassette as a whole based on the amounts of paper currency in the plurality of paper currency housing units in the cassette and whether or not deposit and withdrawal can be performed, and reports the amount of paper currency in the cassette as a whole to the high level device 101, whereby the high level device 101 realizes, without reducing handled denominations, authorized bill withdrawal in the same manner as that in which a conventional paper sheet handling device with one housing unit for each cassette.

Second Embodiment

As one example of this embodiment, a case is described where, in a case where a paper currency housing unit in the cassette has two levels, i.e., upper and lower levels, front-faced paper currency is handled in the upper-level paper currency housing unit and rear-faced paper currency is handled in the lower-level paper currency housing unit and deposit and withdrawal with faces of paper currency all matched are performed. First, process procedures of paper currency housing transaction (deposit processing) in the paper sheet handling device 1000 will be described with reference to FIGS. 1, 2, and 5. Here, the "front-faced paper currency" denotes paper currency whose portrait surface faces upward at time of passage through the identification unit, and the "rear-faced paper currency" denotes paper currency whose portrait surface faces downward at the time of passage through the identification unit.

The main control unit 111, by referring to a status table (to be described later) shown in FIG. 6, determines the amount of paper currency in the cassette as a whole based on the amount of paper currency in the withdrawal only housing unit and the amount of paper currency in the deposit only housing unit, and reports to the high level device 101 the amount of paper currency in the cassette as a whole determined as the amount of paper currency for each cassette. By performing the processes shown below, if the amount of paper currency in each cassette, which has been reported from the main control unit 111, is "Empty", the high level device 101 can recognize that this cassette is capable of deposit but not capable of withdrawal, if this amount is "Paper currency Present", the high level device 101 can recognize that the cassette is capable of deposit and withdrawal, and if the amount is "Full", the high level device 101 can recognize that this cassette is not capable of deposit but capable of withdrawal. Moreover, configuration of the paper sheet handling device 1000 is the same as that for the first embodiment, and therefore its description will be omitted here. Moreover, a status is assumed hereinafter in which paper currency deposit has been received from the operation display unit (not shown).

Figure 5:
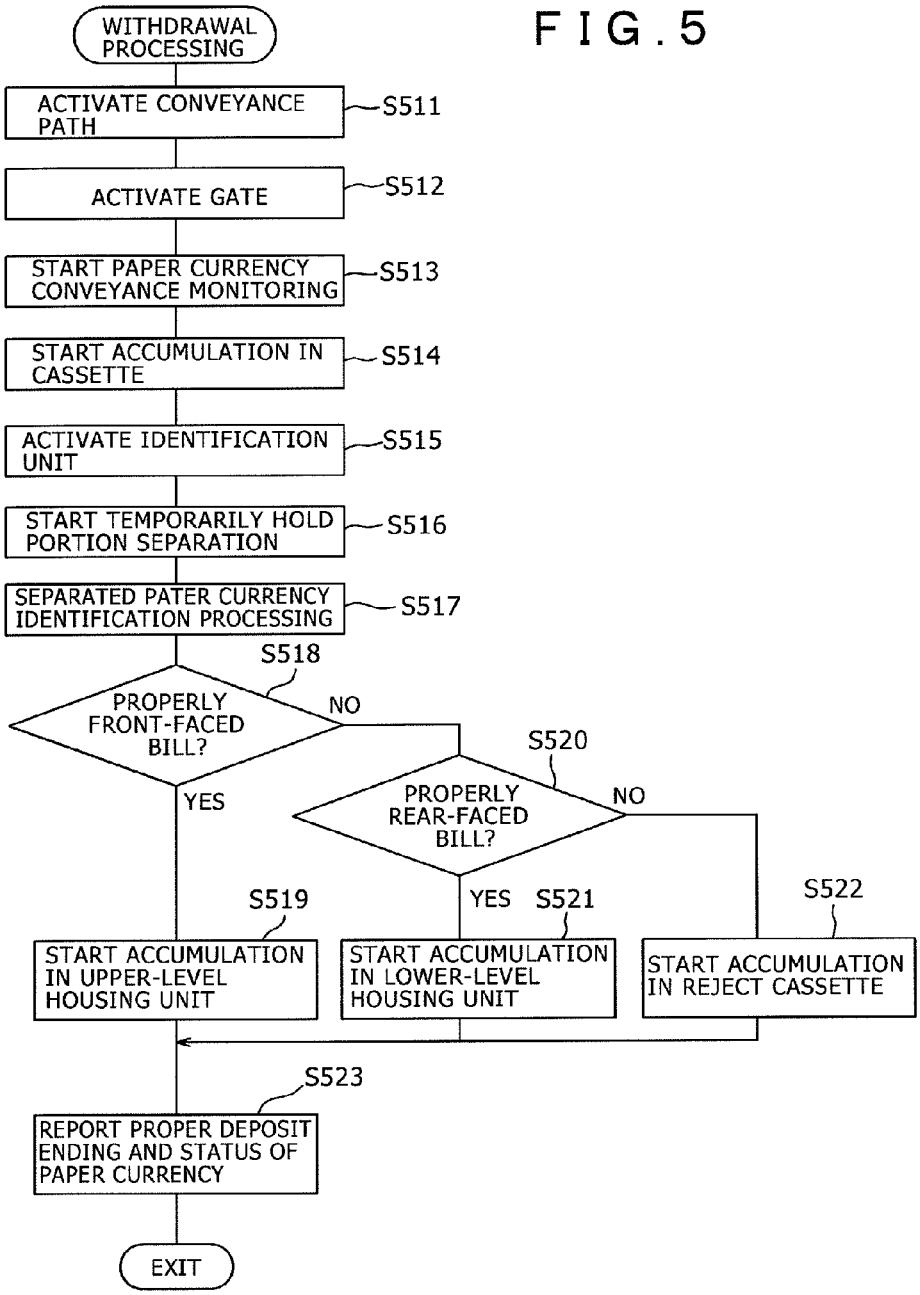
FIG. 5 is a flow chart showing process procedures of deposit processing performed in a paper sheet handling device according to a second embodiment.

As shown in FIG. 5, upon reception of a housing instruction from the high level device 101 via the line control unit 102, the main control unit 111 rotates the conveyance paths 21 to 25 in a direction of accumulation towards the housing unit (step 511) and switches a gate 13 in a conveyance direction from the temporary hold unit 3 to the identification unit 2 (step 512), and provides a paper currency monitoring instruction to the paper currency conveyance monitoring unit 113 (step 513).

The main control unit 111 instructs the cassette control unit 109 for making accumulation preparation of the paper currency cassettes 4*a* to 4*d* and the reject cassette 5 (step 514), instructs the identification control unit 112 for activating the identification unit 2 (step 515), and issues to the temporary hold unit control unit 108 an instruction for separation from the temporary hold unit 3, and individually separates the paper currency (bills) received by the operation display unit (not shown) and accumulated in the temporary hold unit 3 (step 516).

Then the paper currency fed from the temporary hold unit 3 passes through the conveyance path 23, judges authenticity, denomination, and a conveyance status of the paper currency and whether or not it is proper or loss and whether or not it is front-faced or rear-faced, and identification results are reported from the identification control unit 112 to the main control unit 111 (step 517).

Now, the status table according to the second embodiment will be described. FIG. 6 is a diagram showing an example of the status table according to the second embodiment. As shown in FIG. 6, in the status table in the second embodiment in association, there are written, as is the case with the first embodiment: status numbers for identifying a status of paper currency in the paper currency housing unit; amounts of paper currency in the upper-level paper currency housing unit; amounts of paper currency in the lower level paper currency housing unit; and the amount of paper currency in the cassette as a whole. Assumed in an example below is that the upper-level and lower-level paper currency housing units are each used for both deposit processing and withdrawal processing.

In the example shown in FIG. 6, if both the amount of paper currency in the upper-level paper currency housing unit and the amount of paper currency in the lower-level paper currency housing unit are "Empty" (status number 1), the main control unit 111 determines that the amount of paper currency in this cassette as a whole is in an "Empty" status. Similarly, if the amount of paper currency in the upper-level paper currency housing unit is "Empty" and the amount of paper currency in the lower-level paper currency housing unit is "Paper currency Present" (status number 2), the main control unit 111 determines that the amount of paper currency in this cassette as a whole is in a "Paper currency Present" status.

Moreover, if the amount of paper currency in the upper-level paper currency housing unit is "Empty" and the amount of paper currency in the lower-level paper currency housing unit is "Full" (status number 3), the main control unit 111 determines that the amount of paper currency in this cassette as a whole is in a "Paper currency Present" status. The reason why it is determined that the cassette as a whole is in the "Paper currency Present" status even when the upper-level paper currency housing unit is in the "Empty" status is that the paper currency can be deposited to the upper-level paper currency housing unit in the deposit processing. However, at this point, upon determination that the aforementioned operation display unit (not shown) has received a properly rear-faced bill, the main control unit 111 conveys this properly rear-faced bill to the reject cassette 5.

Further, if the amount of paper currency in the upper-level paper currency housing unit is "Paper currency Present" and the amount of paper currency in the lower-level paper currency housing unit is "Empty" (status number 4), the main control unit 111 determines that the amount of paper currency in this cassette as a whole is in a "Paper currency Present" status. Moreover, if both the amounts of paper currency in the upper-level paper currency housing unit and the lower-level paper currency housing unit are in a "Paper currency Present" status (status number 5), the main control unit 111 determines that the amount of paper currency in this cassette as a whole is in a "Paper currency Present" status. The reason why it is determined that the amount of paper currency in the cassette as a whole is in a "Paper currency Present" status in these cases is that deposit to both of the upper-level paper currency housing unit and the lower-level paper currency housing unit can be performed in these statuses.

Further, if the amount of paper currency in the upper-level paper currency housing unit is "Paper currency Present" and the amount of paper currency in the lower-level paper currency housing unit is "Full" (status number 6), the main control unit 111 determines that the amount of paper currency in this cassette as a whole is in a "Paper currency Present" status. The reason why it is determined that the amount of paper currency in the cassette as a whole is in the "Paper currency Present" status even when the lower-level paper currency housing unit is in the "Full" status is that paper currency deposit to the upper-level paper currency housing unit can be performed. However, at this point, upon determination that the operation display unit described above (not shown) has received a properly rear-faced bill, the main control unit 111 conveys this properly rear-faced bill to the reject cassette 5.

Moreover, if the amount of paper currency in the upper-level paper currency housing unit is "Full" and the amount of paper currency in the lower-level paper currency housing unit is "Empty" (status number 7), the main control unit 111 determines that the amount of paper currency in this cassette as a whole is in a "Paper currency Present" status, and if the amount of paper currency in the upper-level paper currency housing unit is "Full" and the amount of paper currency in the lower-level paper currency housing unit is "Paper currency Present" (status number 8), the main control unit 111 determines that the amount of paper currency in this cassette as a whole is in a "Paper currency Present" status. The reason why it is determined that the cassette as a whole is in the "Paper currency Present" status in these cases is that paper currency deposit to the lower-level paper currency housing unit can be performed. However, at this point, upon determination that the aforementioned display operation unit (not shown) has received a properly front-faced bill, the main control unit 111 conveys this properly front-faced bill to the reject cassette 5.

If both the amounts of paper currency in the upper-level paper currency housing unit and the lower-level paper currency housing unit are "Full" (status number 9), the main control unit 111 determines that the amount of paper currency in this cassette as a whole is in a "Full" status. Subsequently, returning to FIG. 5, the processes in step S518 and thereafter will be described.

Then in accordance with identification results, the main control unit 111 determines whether or not this paper currency is a properly front-faced bill (step 518), and if it is a properly front-faced bill (Yes in step 518), the main control unit 111 refers to the status table shown in FIG. 6, gives instructions for depositing to the upper-level paper currency housing unit capable of depositing, accumulates it at the upper-level paper currency housing units of the paper currency cassettes 4*a* to 4*d* that handle the denomination of this paper currency (step 519), and proceeds to step 523.

On the other hand, if the main control unit 111 has determined that this paper currency is not a properly front-faced bill (No in step 518), the main control unit 111 further determines whether or not this paper currency is a properly rear-faced bill (step 520), and if the main control unit 111 has determined that this paper currency is a properly rear-faced bill (Yes in step 520), the main control unit 111 accumulates it in the lower-level housing units in the paper currency cassettes 4*a* to 4*d* that handle the denomination of this paper currency (step 521) and proceeds to step 523.

On the other hand, upon the determination that this paper currency is not a properly rear-faced bill (No in step 520), the main control unit 111 determines that it is a reject bill and accumulates it on the reject cassette 5 (step 522). Then upon accumulation of the paper currency in the temporary hold unit 3 onto the paper currency cassettes 4*a* to 4*d* or the reject cassette 5, the main control unit 111 instructs the conveyance motor control unit 103 for stopping the conveyance paths 21 to 25, and reports proper deposit ending and a cassette status after the deposit to the high level device 101 via the line control unit 102 (step 523). Upon end of this process in step 523, all the processes of the deposit processing shown in FIG. 5 end.

In the second embodiment described above, the deposit processing is described as an example, but in the case of withdrawal processing, of the withdrawal processing according to the first embodiment shown in FIG. 4, each of the processes in steps 401 to 406, the same processing as that of the first embodiment is performed, and in step 407, as is the case with the first embodiment, the main control unit 111 determines, for example, whether or not it is currency exchange processing, and thereby determines whether or not withdrawal instructions from the high level device 101 is withdrawal, such as currency exchange withdrawal, for which a properly front-faced bill is preferable, and further upon determination that it is withdrawal with which a properly front-faced bill is preferable, further in step 408, the main control unit 111 refers to the status table shown in FIG. 6, gives instructions for withdrawal from the upper-level paper currency housing unit capable of withdrawal, and individually separates the specified number of paper currency (bills) from the cassette housing the specified denomination.

On the other hand, upon determination in step 407 that the authorized bill is not preferable for withdrawal, in step 409, the main control unit 111 gives instructions for withdrawal from the lower-level paper currency housing unit capable of withdrawal and individually separates the specified number of paper currency (bills) from the cassette housing the specified denomination. Then each of the processes in steps 410 and 411 of the withdrawal processing according to the first embodiment shown in FIG. 4 is performed, ending the withdrawal processing. As is the case with the first embodiment, upon end of this process in step 411, all the processes of the withdrawal processing according to the second embodiment end.

As described above, the main control unit 111 determines the amount of paper currency in the cassette as a whole based on the amounts of paper currency in the plurality of paper currency housing units in the cassette and whether or not deposit and withdrawal can be performed, and reports the amount of paper currency in the cassette as a whole to the high level device 101, whereby the high level device 101 realizes, without reducing handled denominations, withdrawal with faces all matched in the same method for handling a conventional paper sheet handling device with one housing unit for each cassette.

Third Embodiment

As one example in this embodiment, a case is described where, in a case where the paper currency housing unit in the cassette has two levels, i.e., upper and lower levels, the upper-level paper currency housing unit handles proper bills, the lower-level paper currency housing unit handles loss bills, the proper bills and the loss bills are handled by denomination cassettes, and only the proper bills are withdrawn. First, process procedures of paper currency housing transaction (deposit processing) in the paper sheet handling device 1000 will be described with reference to FIGS. 1, 2, and 7. The "authorized bill" denotes paper currency with little defacement suitable for circulated, and the "loss bill" denotes paper currency with much defacement not suitable for circulated.

The main control unit 111, by referring to a status table shown in FIG. 8 (to be described below), determines the amount of paper currency in the cassette as a whole based on the amount of paper currency in the withdrawal only housing unit and the amount of paper currency in the deposit only housing unit, and reports to the high level device 101 the amount of paper currency in the cassette as a whole determined as the amount of paper currency for each cassette. By performing the processes shown below, if the amount of paper currency in each cassette, which has been reported from the main control unit 111, is "Empty", the high level device 101 can recognize that this cassette is capable of deposit but not capable of withdrawal, if this amount is "Paper currency Present", the high level device 101 can recognize that the cassette is capable of deposit and withdrawal, and if the amount is "Full", the high level device 101 can recognize that the cassette is not capable of deposit but capable of withdrawal. Moreover, it is assumed hereinafter that paper currency deposit has been received from the operation display unit (not shown). Further, configuration of the paper sheet handling device 1000 is the same as that for the first and second embodiments, and therefore its description will be omitted here, and the processes in steps 711 to 717 are the same as the processes in steps 511 to 517 in the second embodiment shown in FIG. 5, and therefore, its description will be omitted here.

Figure 7:
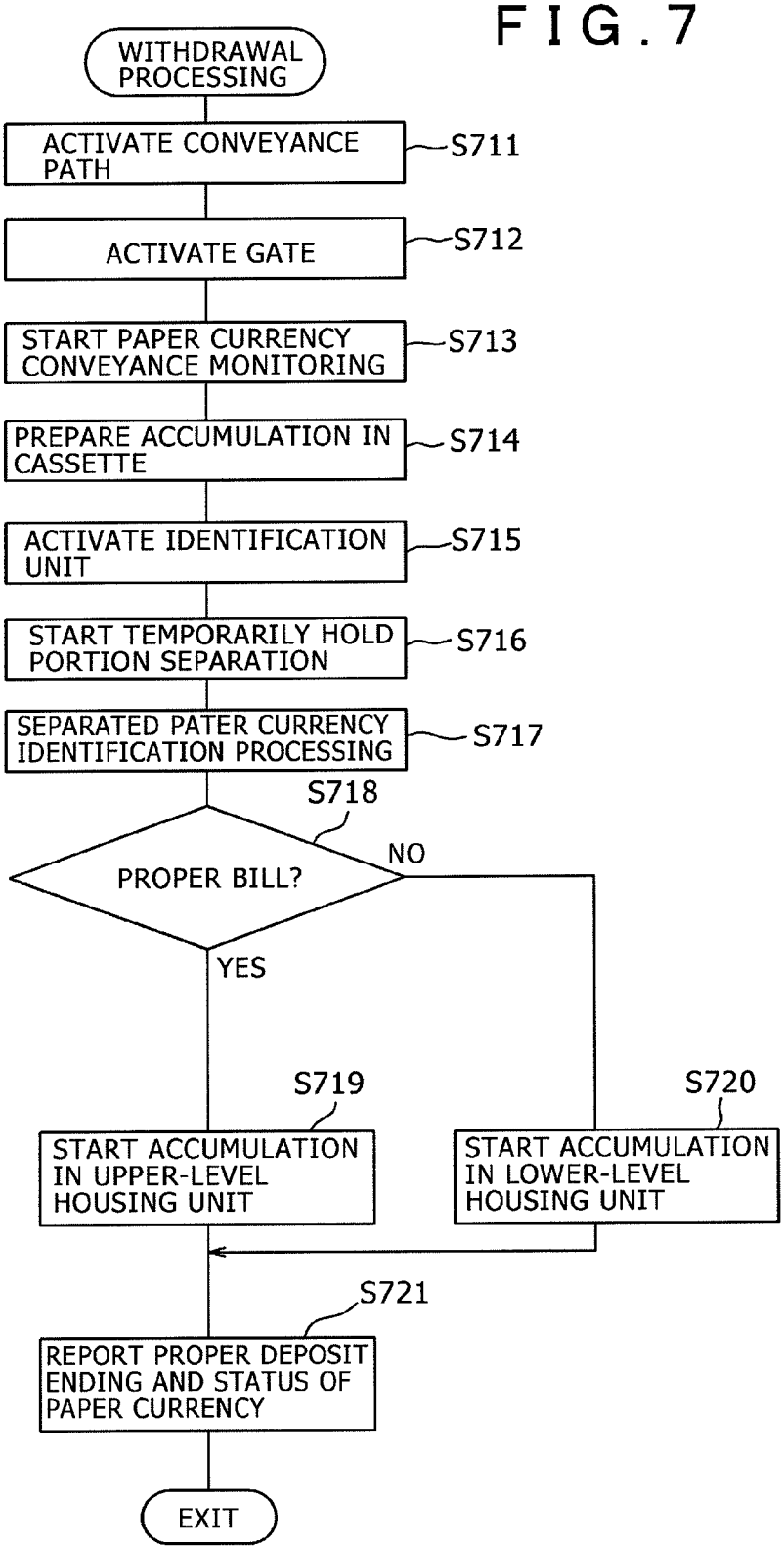
FIG. 7 is a flow chart showing process procedures of deposit processing performed in a paper sheet handling device according to a third embodiment.

As shown in FIG. 7, in step 717, the paper currency fed from the temporary hold unit 3 passes through the conveyance path 23, the identification unit 2 judges authenticity, a denomination, and a conveyance status of paper currency and whether it is proper or loss and whether it is front-faced or rear-faced, and when identification results have been reported from the identification control unit 112 to the main control unit 111, the main control unit 111 determines based on the identification results whether or not it is a proper bill (step 718).

Here, the status table according to the third embodiment will be described. FIG. 8 is a diagram showing an example of the status table according to the third embodiment. As shown in FIG. 8, the status table according to the third embodiment, as is the case with the first and second embodiments, stores in association: status numbers for identifying a status of paper currency in the paper currency housing unit; amounts of paper currency in the upper-level paper currency housing unit; amount of paper currency in the lower-level paper currency housing unit; and amounts of paper currency in the cassette as a whole. It is assumed in the example below that the upper-level paper currency housing unit is used for both deposit processing and withdrawal processing and the lower-level paper currency housing unit is desiccated for deposit processing.

In the example shown in FIG. 8, if both the amounts of paper currency in the upper-level paper currency housing unit and the lower-level paper currency housing unit are "Empty" (status number 1), and if the amount of paper currency in the upper-level paper currency housing unit is "Empty" and the amount of paper currency in the lower-level paper currency housing unit is "Paper currency Present" (status number 2), the main control unit 111 determines that the amount of paper currency in this cassette as a whole is in an "Empty" status. The reason why it is determined that the amount of paper currency in the cassette as a whole is in the "Empty" status even when the lower-level paper currency housing unit is "Paper currency Present" is that the upper-level paper currency housing unit is in the "Empty" status and is not capable of paper currency withdrawal.

Similarly, if the amount of paper currency in the upper-level paper currency housing unit is "Empty" and the amount of paper currency in the lower-level paper currency housing unit is "Full" (status number 3), the main control unit 111 determines that the amount of paper currency in this cassette as a whole is in an "Empty" status. The reason why it is determined that the amount of paper currency in the cassette as a whole is in the "Empty" status even when the lower-level paper currency housing unit is "Full" is the same as the reason for the case of the status number 2 described above. However, at this point, upon determination that the operation display unit described above (not shown) has received a loss bill, the main control unit 111 makes this loss bill conveyed to the reject cassette 5.

Further, if the amount of paper currency in the upper-level paper currency housing unit is "Paper currency Present" and the amount of paper currency in the lower-level paper currency housing unit is "Empty" (status number 4), the main control unit 111 determines that the amount of paper currency in this cassette as a whole is in a "Paper currency Present" status. Moreover, if both the amounts of paper currency in the upper-level paper currency housing unit and the lower-level paper currency housing unit are in a "Paper currency Present" status (status number 5), the main control unit 111 determines that the amount of paper currency in this cassette as a whole is in a "Paper currency Present" status. The reason why it is determined that the cassette as a whole is in the "Paper currency Present" status is that the upper-level paper currency housing unit and the lower-level paper currency housing unit are both capable of deposit in case of these statuses and withdrawal from the upper-level paper currency housing unit can be performed.

Further, if the amount of paper currency in the upper-level paper currency housing unit is "Paper currency Present" and the amount of paper currency in the lower-level paper currency housing unit is "Full" (status number 6), the main control unit 111 determines that the amount of paper currency in this cassette as a whole is in a "Paper currency present" status. The reason why it is determined that the amount of paper currency in the cassette as a whole is in the "Paper currency Present" status even when the lower-level paper currency housing unit is in the "Full" status is that the upper-level paper currency housing unit is capable of paper currency deposit and withdrawal from the upper-level paper currency housing unit can also be performed. However, at this point, upon the determination that the operation display unit (not shown) described above has received a loss bill, the main control unit 111 makes this loss bill conveyed to the reject cassette 5.

Further, if the amount of paper currency in the upper-level paper currency housing unit is "Full" and the amount of paper currency in the lower-level paper currency housing unit is "Empty" (status number 7), the main control unit 111 determines that the amount of paper currency in this cassette as a whole is in a "Paper currency Present" status. The reason why it is determined that the cassette as a whole is in the "Paper currency Present" status even when the upper-level paper currency housing unit is in the "Full" status is that paper currency deposit to the lower-level paper currency housing unit can be performed. However, at this point, the main control unit 111, regardless of whether the operation display unit (not shown) described above has received a proper bill or a loss bill, makes this proper bill or loss bill conveyed to the lower-level paper currency housing unit.

Moreover, if the amount of paper currency in the upper-level paper currency housing unit is "Full" and the amount of paper currency in the lower-level paper currency housing unit is "Paper currency Present" (status number 8), the main control unit ill determines that the amount of paper currency in this cassette as a whole is in a "Paper currency Present" status. The reason why it is determined that the cassette as a whole is in the "Paper currency Present" status in these cases is that paper currency deposit to the lower-level paper currency housing unit can be performed. However, at this point, as is the case with the status number 7, the main control unit 111, regardless of whether the operation display unit (not shown) described above has received a proper bill or a loss bill, makes this proper bill or loss bill conveyed to the lower-level paper currency housing unit. If both the amounts of paper currency in the upper-level paper currency housing unit and the lower-level paper currency housing unit are "Full" (status number 9), the main control unit 111 determines that the amount of paper currency in this cassette as a whole is in a "Full" status. Now, returning to FIG. 7, the processes in step S718 and thereafter will be described.

Then the main control unit 111, upon determination that the paper currency is a proper bill (Yes in step 718), refers to the status table shown in FIG. 8, gives instructions for deposit to the upper-level paper currency housing unit capable of deposit, and accumulates it into the upper-level paper currency housing units in the cassettes 4*a* to 4*d* that handles the denomination of this paper currency (step 719), proceeds to step 721, and performs the same process as that of the second embodiment.

On the other hand, the main control unit 111, upon determination that it is not a proper bill (No in step 718), determines that it is a loss bill, accumulates it into the lower-level paper currency housing units in the paper currency cassettes 4*a* to 4*d* that handles the denomination of this paper currency (step 720), proceeds to step 721, and performs the same process as that of the second embodiment.

In the example described above, the main control unit 111 does not determine whether or not it is a reject bill, but to perform determination of the reject bill, in step 718, it is also possible to further determine whether or not the paper currency is a reject bill, and upon determination that the paper currency is a reject bill, make this paper currency stored in the reject cassette 5.

In the third embodiment above, the example of deposit processing is described, but to perform withdrawal processing, for the processes of steps 401 to 406 of the withdrawal processing according to the first embodiment shown in FIG. 4, the same processes as those of the first embodiment are performed, and in step 407, the main control unit 111, as is the case with the first embodiment, determines whether or not it is currency exchange processing, thereby determines whether or not withdrawal instructions from the high level device 101 is withdrawal, such as currency exchange withdrawal, for which a proper bill is preferable, and further upon determination that the proper bill is preferable for withdrawal, in step 408, further refers to the status table shown in FIG. 8, gives instructions for withdrawal from the upper-level paper currency housing unit capable of withdrawal, and individually separates the specified number of paper currency (bills) from the cassette housing the specified denomination.

On the other hand, in step 407, upon determination that the proper bill is not preferable for withdrawal, the main control unit 111, in step 409, gives instructions for withdrawal from the lower-level paper currency housing unit capable of withdrawal, and individually separates the specified number of paper currency from the cassette housing the specified denomination. Then the processes of steps 410 and 411 of the withdrawal processing according to the first embodiment shown in FIG. 4 are performed, ending the withdrawal processing. As is the case with the first embodiment, upon end of the process of this step 411, all the processes of the withdrawal processing according to the third embodiment end.

As described above, the main control unit 111 determines the amount of paper currency in the cassette as a whole based on the amounts of paper currency in the plurality of paper currency housing units in the cassette, and reports the amount of paper currency in the cassette as a whole to the high level device 101, whereby the high level device 101, without reducing handled denominations, handles proper bills and loss bills in the denomination cassettes and realizes withdrawal of only the proper bills in the same method for handling the conventional paper sheet handling device with one housing unit for each cassette.

As shown in the first to third embodiments described above, by using a recycle cassette having a gate switching between a plurality of paper currency housing units capable of deposit and withdrawal and a paper currency housing unit for deposit and withdrawal and one paper currency gateway, the same denomination is handled in all the paper currency housing units in the cassette and paper currency with different properties are handled in the different paper currency housing units in the cassette, and for a high-level system (cash automatic transaction device or the like) using a paper sheet handling device, the cassette as a whole is operated as one housing unit, and when instructions for withdrawing a specified denomination have been given from the high-level system, from properties of the paper currency that can be withdrawn at the control unit of the paper sheet handling device, the optimal paper currency property is determined and the paper currency is withdrawn from the paper currency housing unit handling the optimal paper currency property of the cassette that handles the denomination for which the withdrawal instructions have been given. Therefore, it is possible to provide a service for withdrawing paper currency with an optimal property only by changing the paper sheet handling device without reducing the number of denominations that can be handled and also without changing the high-level system.

The present invention is not directly limited the embodiments described above, and elements can be modified and embodied in implementation within a range not departing from the spirits of the invention. Moreover, the plurality of elements disclosed in the embodiments described above can be combined as appropriate to thereby form various inventions. For example, several elements shown in the embodiments may be eliminated. Further, the elements of the different embodiments may be combined together as appropriate.

EXPLANATION OF REFERENCES

1 deposit and withdrawal port
2 identification unit
3 temporary hold unit
4*a* to 4*d* cassettes
5 reject cassette
6 forgotten paper currency collection box
11 passage sensor
12 and 13 gates
21 to 25 conveyance paths
40 cassette internal gate
41 upper level housing unit empty detecting sensor
42 upper housing unit full detecting sensor
43 lower level housing unit empty detecting sensor
44 lower level housing unit full detecting sensor

What is claimed is:

1. A paper sheet handling device performing paper-sheet-related transaction with a customer, the paper sheet handling device comprising:

a deposit and withdrawal port for depositing and withdrawing the paper sheet;

a plurality of cassettes provided for each kind indicating a kind of the paper sheet when classification is made based on a value of the paper sheet, the cassettes each having a plurality of housing units in itself capable of housing paper sheets with mutually different properties indicating the kinds of the paper sheet when the paper sheet is classified based on an element other than the kind;

an identification unit being provided between the deposit and withdrawal port and the plurality of cassettes, the identification unit identifying the kind and the property of the paper sheet deposited through the deposit and withdrawal port;

a conveyance path linking together the deposit and withdrawal port, the identification unit, and each of the housing units;

a storage unit storing in association: a housing unit housing status as a housing status of the paper sheet for each of the plurality of housing units; and a cassette housing status as a housing status of the paper sheet in the cassette as a whole having the plurality of housing units; and a main control unit executing deposit and withdrawal processing of the paper sheet based on the housing unit housing status and the cassette housing status stored in the storage unit, storing in the storage unit the housing unit housing status and the cassette housing status after the execution, and reporting the stored housing unit housing status and cassette housing status to a high-level device managing the paper sheet handling device.

2. The paper sheet handling device according to claim 1, further comprising a switching gate, for each of the cassettes, accumulating and depositing the paper sheet to each of the housing units included in the cassette, or separating and withdrawing the paper sheet from each of the cassettes, wherein the main control unit switches the switching gate to execute the deposit and withdrawal processing.

3. The paper sheet handling device according to claim 1, wherein each of the cassettes is attachable to the paper sheet handling device and detachable therefrom and is provided in accordance with a size of the paper sheet of the kind.

4. The paper sheet handling device according to claim 1, wherein each of the housing units included in each of the cassettes, as the paper sheet, accumulates an authorized bill never used after issue of the paper sheet into one housing unit and accumulates a circulated bill once used after the issue of the paper sheet into another housing unit, and the control unit determines whether or not deposit and withdrawal with the authorized bill is required, thereby withdrawing the authorized bill or the circulated bill from each of the housing units included in each of the cassettes, or depositing the authorized bill or the circulated bill into each of the housing units included in each of the cassettes.

5. The paper sheet handling device according to claim 4, wherein the main control unit, upon determination that the paper sheet does not apply to the authorized bill and the circulated bill accumulates the paper sheet onto a reject cassette provided separately from the cassettes.

6. The paper sheet handling device according to claim 1, wherein each of the housing units included in each of the housing cassettes, as the paper sheet, accumulates, of the paper sheets, a proper bill with little defacement suitable for circulated into one housing unit, and accumulates, of the paper sheet, a loss bill with much defacement not suitable for circulated into another housing unit, and the main control unit determines whether or not deposit and withdrawal in the proper bill is required, thereby withdrawing the proper bill from each of the housing units included in each of the cassettes, or depositing the proper bill into each of the housing units included in each of the cassettes.

7. The paper sheet handling device according to claim 6, wherein the main control unit, upon determination that the paper sheet does not apply to the proper bill and the loss bill accumulates the paper sheet onto a reject cassette provided separately from the cassettes.

8. The paper sheet handling device according to claim 1, wherein each of the housing units including in each of the cassettes, as the paper sheet, accumulates, of the paper, sheet, a front-faced bill with a portrait surface faced upward upon passage through the identification unit, into one housing unit, and accumulates, of the paper sheet, a rear-faced bill with the portrait surface faced downward upon the passage through the identification unit into another housing unit, and the main control unit determines whether or not deposit and withdrawal in the front-faced bill is required, thereby withdrawing the front-faced bill and the rear-faced bill from each of the housing units included in each of the cassettes, or depositing the front-faced bill and the rear-faced bill into each of the housing units included in each of the cassettes.

9. The paper sheet handling device according to claim 8, wherein the main control unit, upon determination that the paper sheet does not apply to the front-faced bill and the rear-faced bill accumulates the paper sheet onto a reject cassette provided separately from the cassettes.

* * * * *